US008182353B2

(12) United States Patent
Schellhorn

(10) Patent No.: US 8,182,353 B2
(45) Date of Patent: May 22, 2012

(54) BOTTOM ROLLER DRIVE FOR DEEP SOIL MIXING SYSTEM

(76) Inventor: Verne L. Schellhorn, Gualala, CA (US)

( * ) Notice: Subject to any disclaimer, the term of this patent is extended or adjusted under 35 U.S.C. 154(b) by 0 days.

(21) Appl. No.: 12/734,891

(22) PCT Filed: Mar. 8, 2010

(86) PCT No.: PCT/US2010/000691

§ 371 (c)(1),
(2), (4) Date: May 27, 2010

(87) PCT Pub. No.: WO2010/104559

PCT Pub. Date: Sep. 16, 2010

(65) Prior Publication Data

US 2011/0308863 A1 Dec. 22, 2011

Related U.S. Application Data

(60) Provisional application No. 61/209,831, filed on Mar. 11, 2009.

(51) Int. Cl.
*E21B 17/07* (2006.01)

(52) U.S. Cl. ..... 464/165; 175/195

(58) Field of Classification Search ..... 464/163–165; 166/78.1; 175/195; 173/165; 405/232, 263, 405/267, 269

See application file for complete search history.

(56) References Cited

U.S. PATENT DOCUMENTS

| | | | | |
|---|---|---|---|---|
| 164,086 | A * | 6/1875 | Horn | 175/195 |
| 1,259,852 | A * | 3/1918 | Greve | 464/163 |
| 2,629,586 | A * | 2/1953 | Harbour | 464/163 X |
| 4,095,656 | A | 6/1978 | French | |
| 5,890,844 | A * | 4/1999 | Schellhorn | |

* cited by examiner

*Primary Examiner* — Gregory Binda
(74) *Attorney, Agent, or Firm* — Bruce H. Johnsonbaugh

(57) ABSTRACT

A bottom roller drive mechanism for a subterranean soil processing tool is provided. The tool is connected to a string of Kelly bar sections. Each Kelly bar section has a preferably square, or other polygonal, cross-section. A plurality of roller wheels is mounted in a drive assembly connected to the bottom rotary drive plate. The roller wheel assembly engages the faces of each Kelly bar section and rotates the Kelly bar around a vertical axis A-A. The upper and lower ends of each Kelly bar section are tapered to form a reduced cross-section at each joint. The roller drive assembly is free to rotate at each joint without rotating the Kelly bar. This allows misaligned Kelly bar sections to pass through the drive mechanism.

5 Claims, 9 Drawing Sheets

BOTTOM ROLLER DRIVE FOR DEEP SOIL MIXING SYSTEM

CROSS REFERENCE TO RELATED APPLICATION

This application claims the benefit of and priority from U.S. provisional application Ser. No. 61/209,831 filed Mar. 11, 2009.

BACKGROUND AND BRIEF SUMMARY

The present invention pertains generally to deep soil subterranean mixing or processing. In particular, the invention provides an improved system used to drive a subterranean soil processing/mixing tool.

Deep soil mixing systems have been used to create subterranean structures such as building foundations, bridge and overpass footings, as well as subterranean supports for airport runways, levees and sea walls. The deep soil processing/mixing systems include the systems described in the following U.S. patents, all of which are incorporated herein by reference: U.S. Pat. Nos. 4,793,740; 4,958,962; 5,396,964; 5,890,844; 6,183,166; 6,241,426; 6,988,856 and 7,377,726. These prior art systems have inherent, significant limitations imposed by the drive system used to rotate the soil processing tool. These limitations include the amount of torque applied and the horizontal "reach" attainable by the crane.

These limitations imposed on prior art deep soil processing/mixing systems are primarily a result of the perceived requirement to use "top drive" systems with multi-sectional round Kellys. A "top drive" system is typically a heavy, hydraulic drive unit positioned high above ground level (usually 50-100 feet). The drive unit is connected to the top of a round Kelly section and moves downwardly with the Kelly. When multi-piece round Kelly bars are used, the drive unit is separated from each Kelly piece slightly above ground level. The drive unit is then hoisted up to be connected to the top of the next round Kelly piece. This process is time consuming and expensive. These top drive units create large amounts of torque (30,000 to 40,000 ft. lbs.) that must be resisted by the lead column, the crane boom or both. The heavy drive unit positioned high above ground level and producing large amounts of torque creates a top-heavy, vibration prone system with limitations on applied torque. The top drive systems require the use of relatively heavy cranes to support the drive system and to resist the applied torque and vibrations.

The prior art also includes the use of multi-sectional Kellys having a square cross-section (or other polygonal cross-sections). Such Kellys are capable of transmitting more torque and may utilize either a top drive or a bottom drive wherein a rotary drive table applies the torque. Multi-sectional square Kellys are also known in the art (see U.S. Pat. No. 5,396,964 at column 10, line 54—column 11, line 10). The problem with multi-sectional square Kellys is that the adjacent sections become misaligned after several uses and are unable to pass downwardly through the rotary drive table.

The present invention, for the first time, provides a bottom drive system utilizing a novel roller design that overcomes the inherent limitations of the prior art noted above. The bottom drive system of the invention is capable of generating and effectively using 200,000 ft. lbs. of torque, about 5 times as much as the prior art. The novel bottom roller drive system overcomes the problem of misaligned square Kellys and eliminates the need for a heavy "top drive," used with round or square Kellys, reducing the weight required of the crane and allowing a greater horizontal "reach" of the crane. The novel bottom roller drive greatly reduces, and in some cases eliminates, the intense vibrations otherwise induced in the crane boom, lead column and Kelly bar by the prior art top drive.

A primary object of the invention is to provide a bottom roller drive system for a subterranean soil processing tool utilizing square (or other polygonal) cross-section Kellys and using about 5 times as much torque as prior art drive systems.

A further object of the invention is to provide a bottom roller drive system usable with square Kellys wherein misaligned Kellys are able to move upwardly and downwardly through the drive system.

Another object of the invention is to provide a novel bottom roller drive system for a subterranean soil processing tool which reduces the weight of the crane and which allows a greater horizontal "reach" of the crane.

Other objects and advantages will become apparent from the following description and drawings.

DETAILED DESCRIPTION OF THE DRAWINGS

Figure 1:
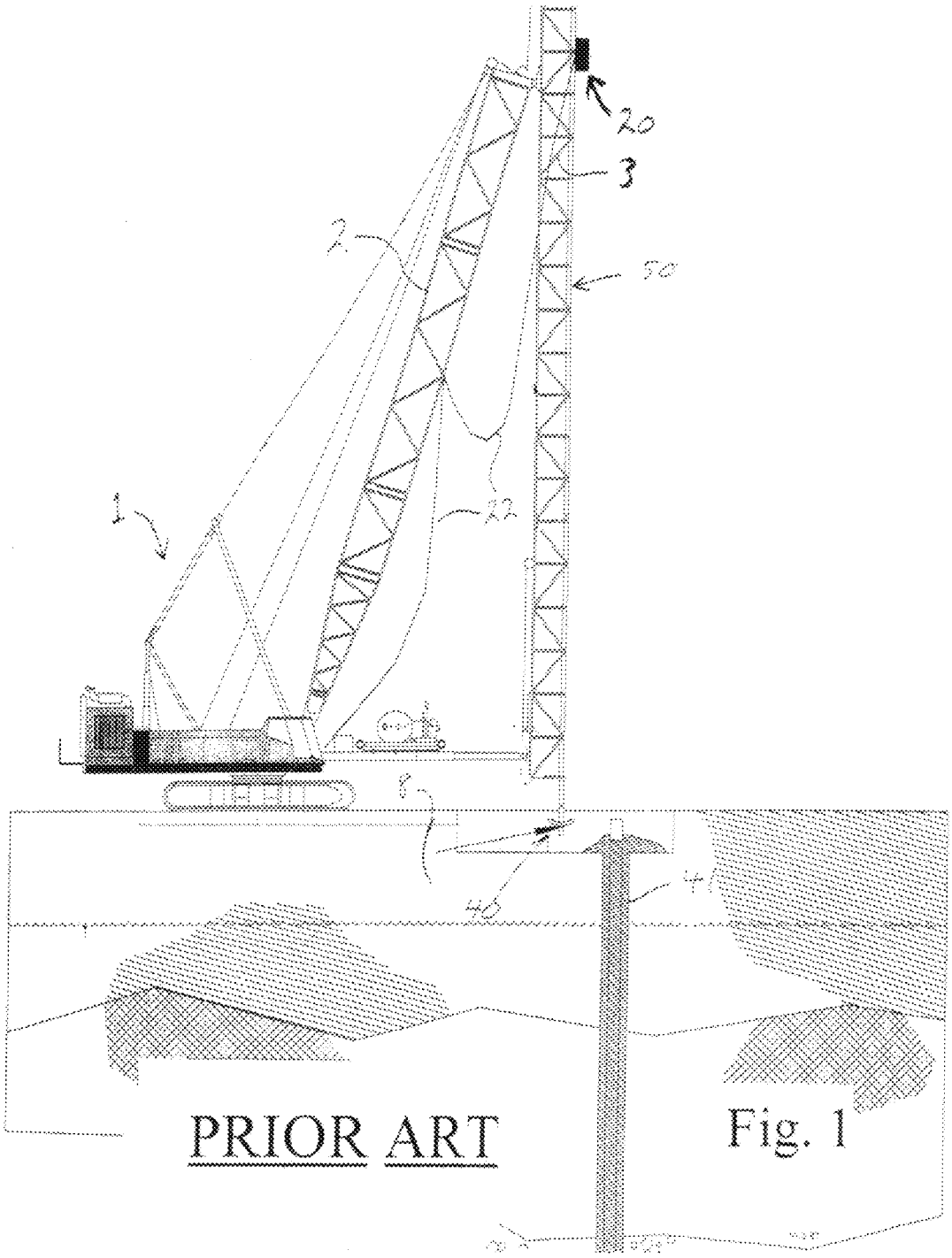
PRIOR ART Fig. 1
FIG. 1 illustrates a prior art top drive system.

FIG. 1 illustrates a prior art "top drive" system. A crane 1 is positioned adjacent a hole 41 in which soil processing has been performed. A soil processing tool 40 has been withdrawn from hole 41. Crane 1 has a boom 2 which is connected to lead column 3. Lead column 3 supports a round drive Kelly 50 which is driven by a hydraulic drive unit 20 positioned at the top of Kelly 50. Crane 1 is in position to start drilling a new hole to the left of hole 41. As the new hole is drilled, the hydraulic top drive unit 20 moves downwardly with round Kelly 50 to cause the soil processing tool 40 to bore down into sub-soil 8. It is significant to note that the hydraulic drive unit 20 requires approximately 200 ft. of relatively heavy hydraulic hose 22. As described below, the present invention avoids the use of almost all of that hydraulic hose. As noted above, the weight of top drive unit 20 is substantial. The torque generated by drive unit 20 is also substantial, requiring a substantial lead column 3 and a heavy crane 1 to withstand the torque generated by drive unit 20.

Figure 2B:
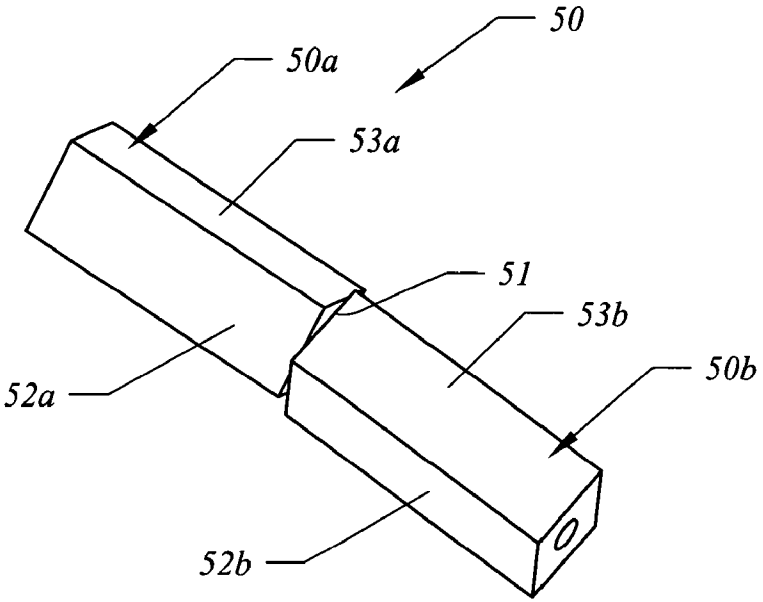
FIG. 2B (Prior Art)
FIG. 2B illustrates two adjacent prior art Kelly bar sections that are misaligned.
Figure 2A:
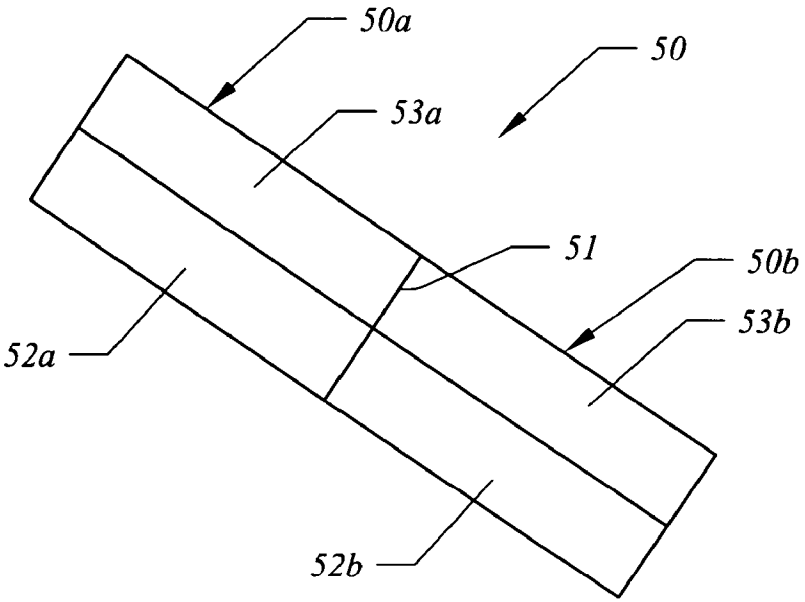
FIG. 2A (Prior Art)
FIG. 2A illustrates two adjacent prior art Kelly bar sections that are aligned.

FIGS. 2A and 2B are schematic illustrations showing why the multi-sectional square Kelly bars of the prior art cannot be effectively used with a prior art bottom drive system.

FIG. 2A shows schematically a prior art, two section Kelly bar 50 having a first section 50*a* and a second section 50*b*. It is to be understood that FIGS. 2A and 2B (and other Figures herein), illustrate only the end portions of each elongated Kelly bar section for clarity. The sections are connected at joint 51 by a threaded connection known in the art (see U.S. Pat. No. 5,396,964 at col. 10, line 54) and not illustrated in FIG. 2A for clarity. Each of the sections 50*a* and 50*b* has a square cross section. Each section 50*a* and 50*b* has flat planar surfaces 52*a*, 52*b* and 53*a*, 53*b* visible in FIG. 2A. The planar surfaces 52*a* and 52*b* are aligned and are coplanar, as are flat surfaces 53*a* and 53*b*. However, as the two sectional Kelly bar 50 is used several times and subjected to the torque required to advance the soil processing tool 40 downwardly, the two sections 50*a* and 50*b* become misaligned as illustrated in FIG. 2B. The surfaces 52*a* and 52*b* are no longer coplanar, and neither are surfaces 53*a* and 53*b*. The misalignment of the surfaces of adjacent square Kelly bar sections 50*a* and 50*b* creates a serious problem with prior art rotary table bottom drive tools. These prior art bottom drive tools will not allow the non-aligned or misaligned adjacent Kelly bar sections and joint 51, as shown in FIG. 2B, to pass through the bottom roller drive system.

A primary object of the present invention is to provide a bottom roller drive system that is capable of allowing a misaligned multi-sectional square Kelly bar to pass through the drive mechanism. As described below, a novel joint is provided between adjacent Kelly bar sections 50*a* and 50*b*.

Figure 3:
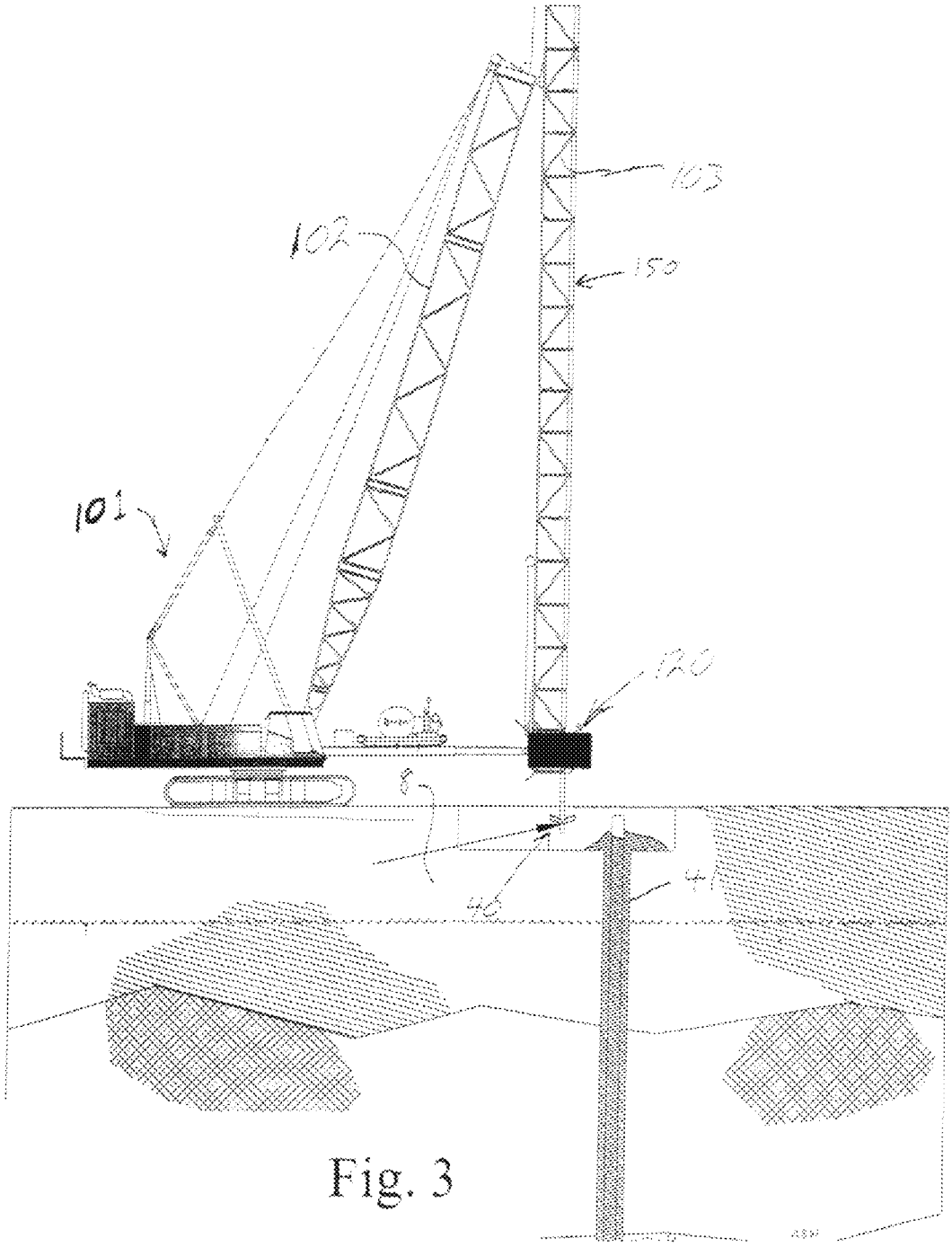
FIG. 3 illustrates the bottom roller drive system of the present invention relative to the crane, boom and lead column which it is used.

FIG. 3 illustrates the positioning of the new bottom roller drive system 120 of the present invention relative to crane 101. Crane 101 has a boom 102 and a lead column 103. Crane 101, boom 102 and lead column 103 may be considerably lighter than the prior art crane 1 illustrated in FIG. 1 and still be capable of powering the same size tool 40, shown in FIG. 1.

Figure 5:
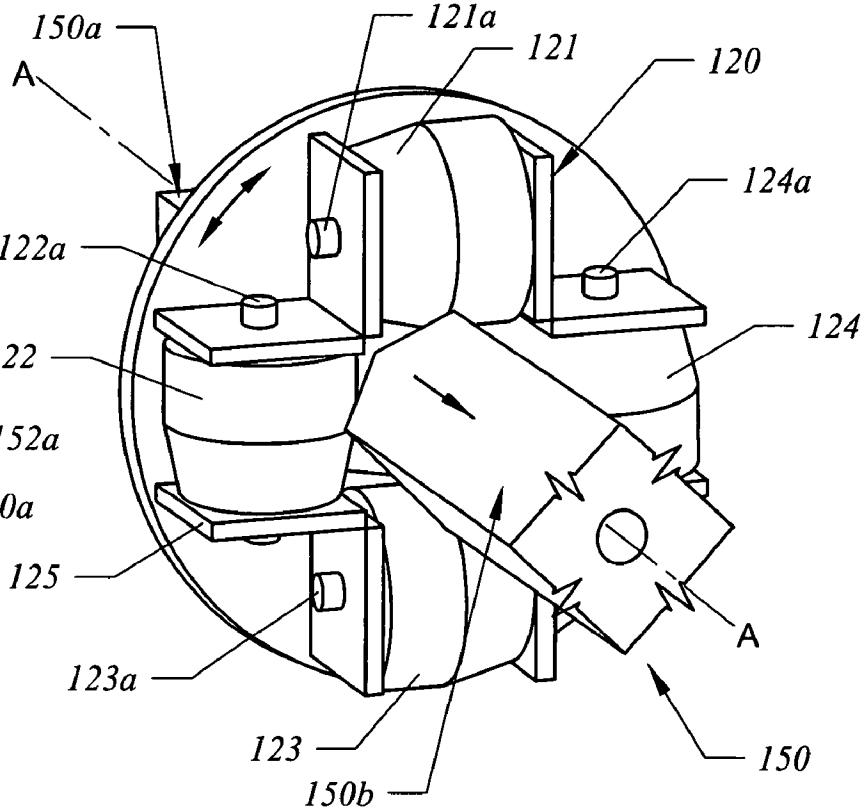
FIGS. 4 and 5 are top and bottom views, respectively, of the roller drive assembly of the present invention.
Figure 4:
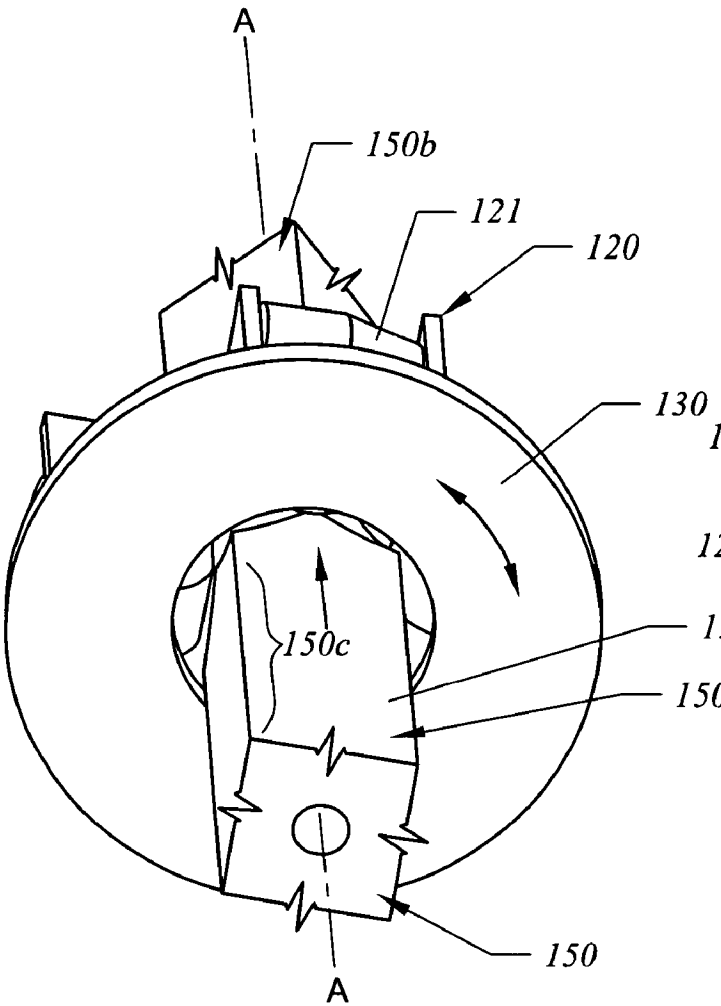

FIGS. 4 and 5 are top and bottom views, respectively, of the bottom roller drive assembly 120 according to the present invention. Referring to FIG. 4, a modified, two section Kelly bar 150 having a square cross section is shown having an upper section 150*a* and lower section 150*b*. These two sections are threaded together to form a joint (not visible in FIG. 4 or 5). A flat circular drive plate 130 supports the roller drive assembly 120 and is connected to a standard rotary drive table (not shown for clarity). Each of the Kelly bar sections 150*a* and 150*b* shown in FIGS. 4 and 5 may be 30 to 50 feet in length. FIGS. 4 and 5 show approximately the bottom 2 to 3 feet of section 150*a* and the top 2 to 3 feet of section 150*b*. Each of sections 150*a* and 150*b* has a central region 150*c* which extends along nearly the entire length of each section, except for approximately one foot at the top and bottom of each section. As shown best in FIG. 11, a portion of section 150*a* is illustrated, showing the central region 150*c*, the bottom tip 159 and a tapered bottom end section 156, described further below. Each Kelly bar section has a tapered bottom end and top similar to bottom end 156 shown in FIG. 11. The bottom tip 159 (and upper tip) of each section has a preferably circular cross-section. The bottom tip of each section carries a male connecting thread 180; the upper tip of each section carries a female threaded opening (not shown for clarity) that receives connecting thread 180.

The bottom view shown in FIG. 5 illustrates the bottom section 150*b* of Kelly bar 150. Section 150*b* has moved downwardly a sufficient distance so that roller drive assembly 120 is adjacent the joint area between sections 150*a* and 150*b*, which joint section is illustrated in detail below. The basic concept of the present invention is to provide a tapered surface providing a recess at each end of each Kelly bar section that is formed in such a way to allow the roller drive assembly 120 to rotate about the longitudinal axis A-A of rotation of Kelly bar 150 at the joint without causing the Kelly bar to rotate. When each joint is adjacent the roller drive assembly, the rollers do not contact either the flat faces or the tapered ends of the Kelly bar sections. Such rotation of drive assembly 120 around axis A-A allows a misaligned, multi-sectional Kelly to pass through assembly 120 either upwardly or downwardly.

The roller drive assembly 120 is connected to the rotary drive table (not shown for clarity) as known in the art. Drive assembly 120 includes a plurality of four rollers 121-124 which rotate about axles 121*a*-124*a*. Axles 121*a*-124*a* are carried in brackets 125 which are welded to drive plate 130. Axles 121*a*-124*a* each lie on a horizontal axis parallel to one of the flat faces of the central region of the Kelly bar. For example, as shown in FIG. 4, roller 121 rotates about an axis formed by axle 121*a*, and roller 121 contacts (or is about to contact) flat face 152*a* of Kelly bar section 150*a*. Roller 121 rolls against flat surface 152*a* as Kelly bar 150 moves upwardly or downwardly on axis A-A.

The roller drive wheels 121-124 are illustrated in FIGS. 4 and 5 as being aligned with the flat surfaces of Kelly bar section 150*a*. As shown in FIG. 4, roller 121 is about to engage flat surface 152*a* of Kelly section 150*a*. When roller wheel 121 is fully engaged with flat surface 152*a*, the rotary drive table (not shown in FIGS. 4 and 5) is actuated which in turn rotates drive plate 130 around axis A-A to rotate Kelly bar 150. The rotation of Kelly bar 150 is caused by the engagement of roller wheels 121-124 with the flat surfaces of square Kelly bar 150. As Kelly bar 150 is driven downwardly or raised upwardly, roller 121 rolls against flat surface 152*a*.

Figure 7:
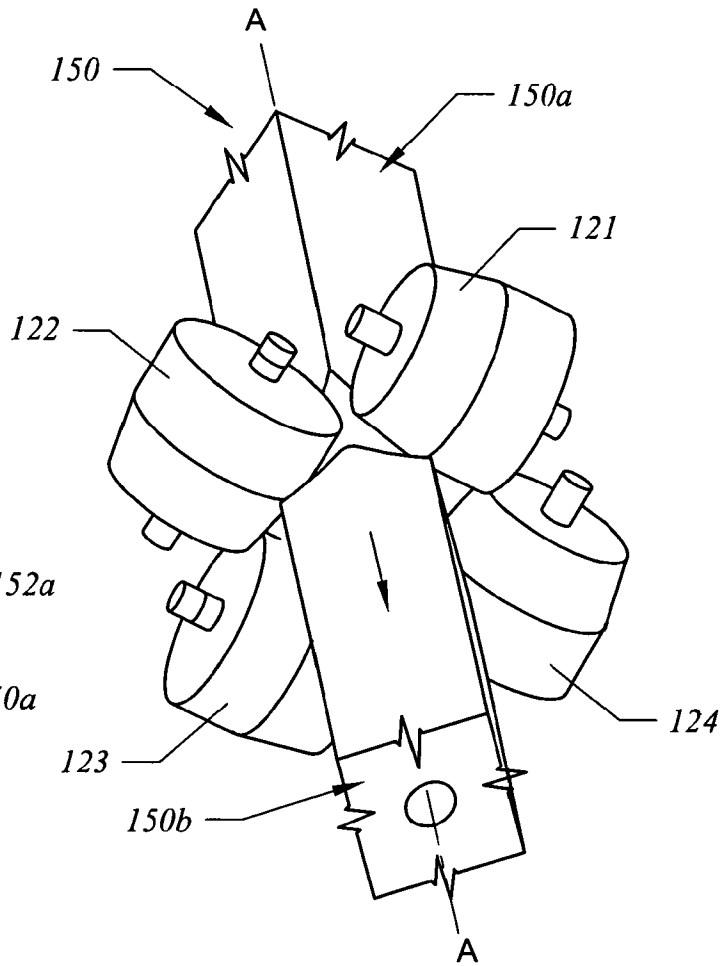
FIGS. 6 and 7 are top and bottom views, respectively, of the roller drive assembly shown in FIGS. 4 and 5, wherein the drive plate and brackets for mounting the rollers have been deleted for clarity.
Figure 6:
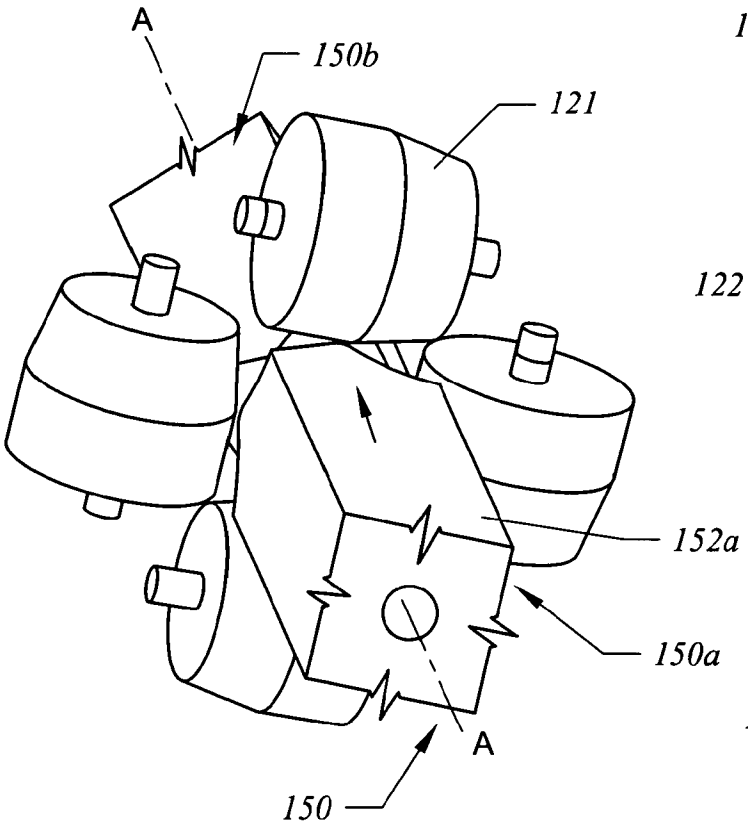

FIGS. 6 and 7 correspond generally to FIGS. 4 and 5 but in which the drive plate 130 and brackets 125 for mounting the roller axles have been deleted to more clearly show the interaction of the roller wheels 121 with the novel, newly formed joint between Kelly sections 150*a* and 150*b*. As shown in FIG. 6 roller wheel 121 is starting to contact flat surface 152*a* of section 150*a*.

Figure 8:
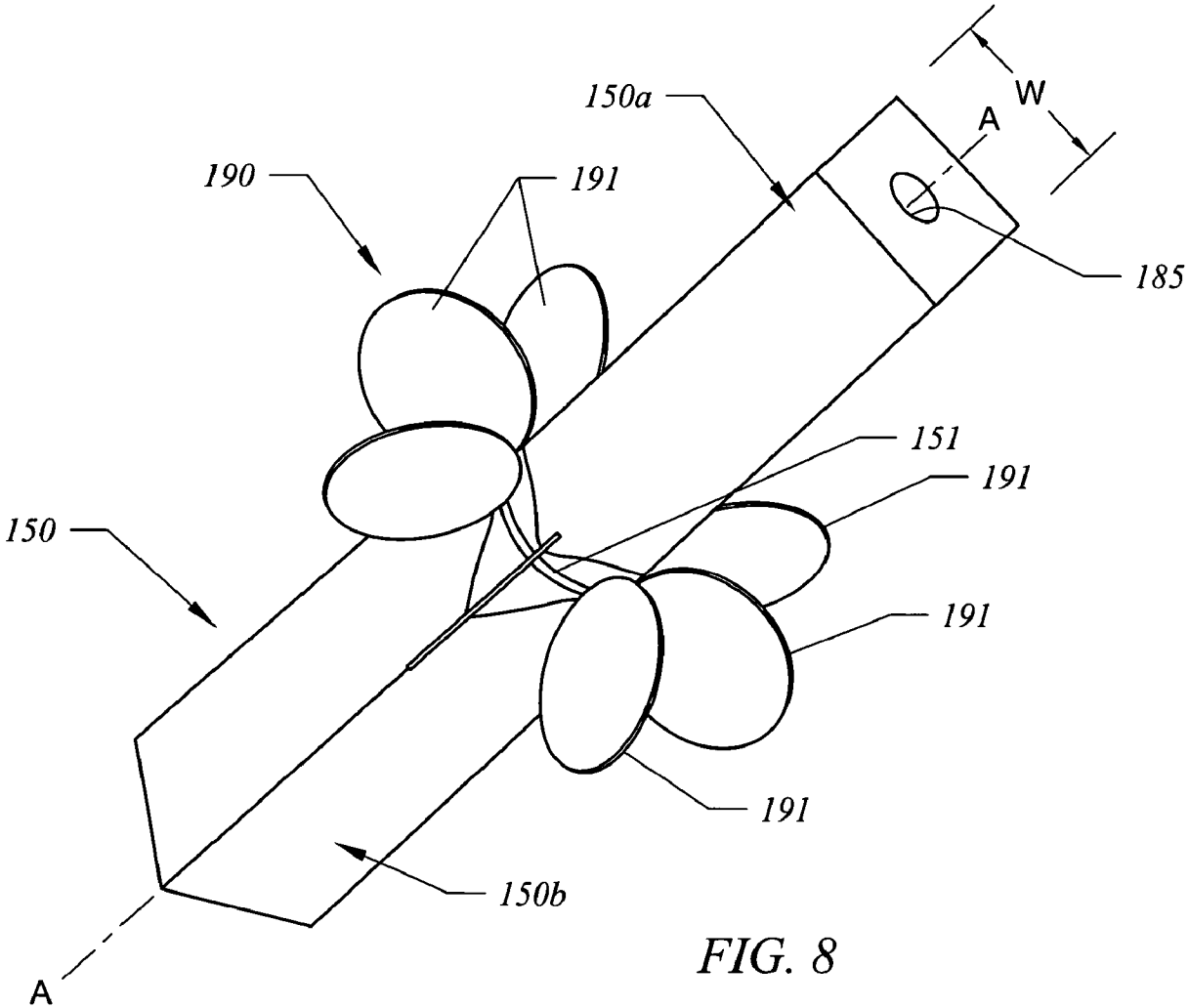
FIG. 8 is a schematic illustration showing conceptually how the tapered ends of each Kelly section are formed.

FIG. 8 illustrates the conceptual manner in which the joint 151 between upper Kelly bar section 150*a* and lower Kelly bar section 150*b* is formed. An imaginary torus, referred to as 190 in FIG. 8, extends around joint 151 and is illustrated as a plurality of discs 191. Each of these imaginary discs has a diameter greater than the width w of each face of the Kelly bar section. For example, a diameter of preferably 8 inches whereas the Kelly bar section 150*a* having a uniform width w preferably of approximately 7 inches for each of the four faces of the square cross section. Other dimensions could be utilized for the width of the Kelly bar as well as for the diameters of the imaginary torus 190. The opening 185 illustrated in FIG. 8 is the hollow center of Kelly sections 150*a* and 150*b* which allows the introduction of high pressure cement slurry to high pressure nozzles carried by the soil processing tool as known in the prior art.

Figure 9:
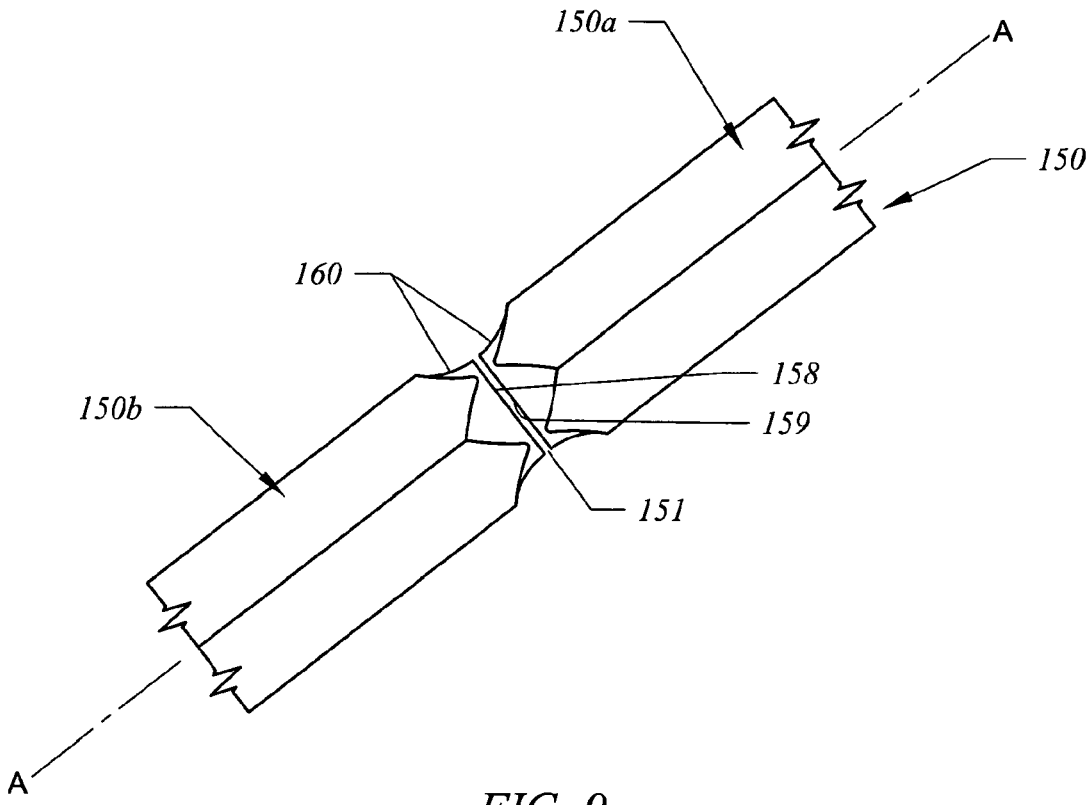
FIG. 9 illustrates the joint between two adjacent Kelly bar sections with the Kelly bar sections aligned with each other.
Figure 10:
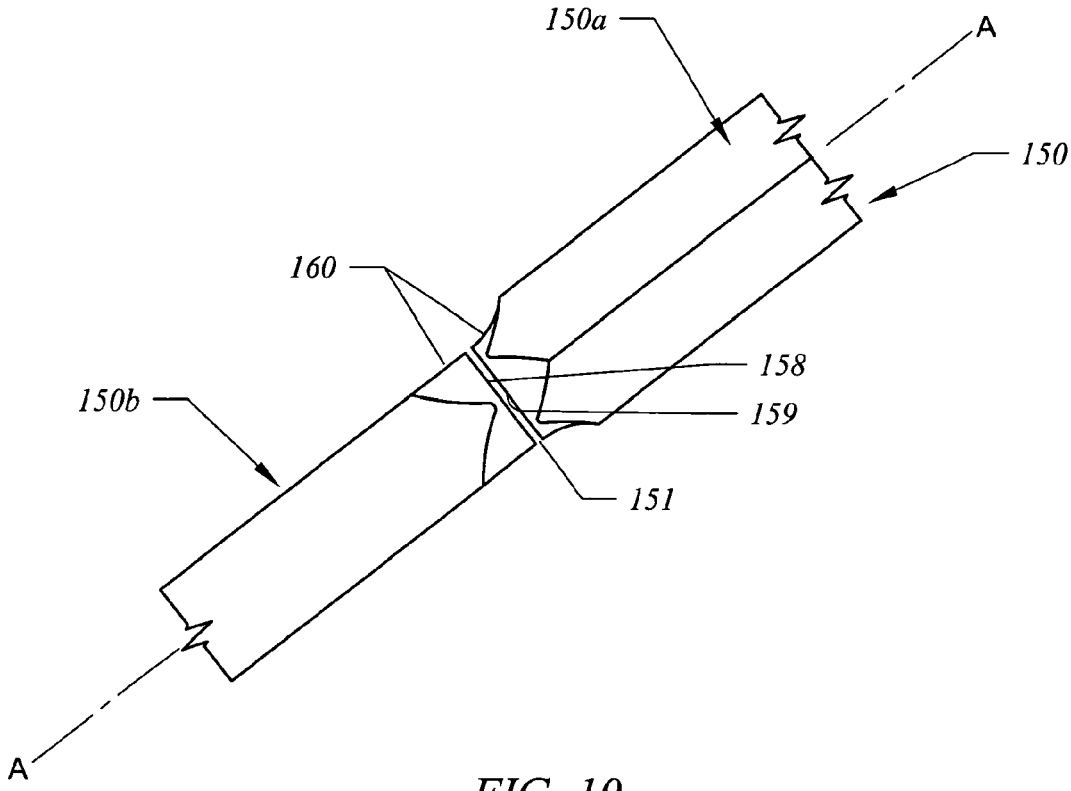
FIG. 10 illustrates the joint between two adjacent Kelly bar sections wherein the Kelly bar sections are misaligned.

FIGS. 9 and 10 illustrate Kelly sections 150*a* and 150*b* after the imaginary toroidal surface cut has been made to form the joint illustrated as 151. It is significant to note that in FIG. 9 the threaded member that connects sections 150*a* and 150*b* is deleted for clarity. The tapered, preferably toroidal shaped surface, referred to as 160 in FIG. 9, allows the roller drive assembly 120 to be freely rotated relative to multi-sectional Kelly bar 150 when joint 151 is adjacent the roller drive assembly 120 whether or not the individual Kelly sections 150*a* and 150*b* have their surfaces aligned with each other. In this manner, misaligned adjacent Kelly bar sections may pass through roller drive assembly 120. The tapered section 160 is formed at the upper and lower ends of each Kelly bar section as shown in FIG. 9 and preferably form a circular cross-section at joint 151, where the lower tip 159 of section 150*a* is adjacent upper tip 158 of section 150*b*. The surface of tapered section 160 can be other shapes than that described as formed by an imaginary torus. The important aspect of tapered section 160 is that it be shaped to allow the roller drive assembly 120 to rotate around axis A-A when section 160 is adjacent the roller drive, without rotating the Kelly bar 150. Tapered section 160 is tapered inwardly toward axis A-A in a direction extending from the central region toward the tip of each Kelly bar section.

FIG. 10 corresponds generally to FIG. 9 but wherein Kelly section 150*b* has been rotated 45° to illustrate a non-alignment or misalignment of sections 150*a* and 150*b* and to illustrate the complex shape of the joint 151 and joint surfaces 160 when the sections are misaligned. When the Kelly sections 150*a* and 150*b* are misaligned, as shown in FIG. 10, the rollers 121-124 and surfaces 160 are shaped so that multi-sectional Kelly bar 150 may be rotated slightly to pass downwardly through drive assembly 120.

Figure 11:
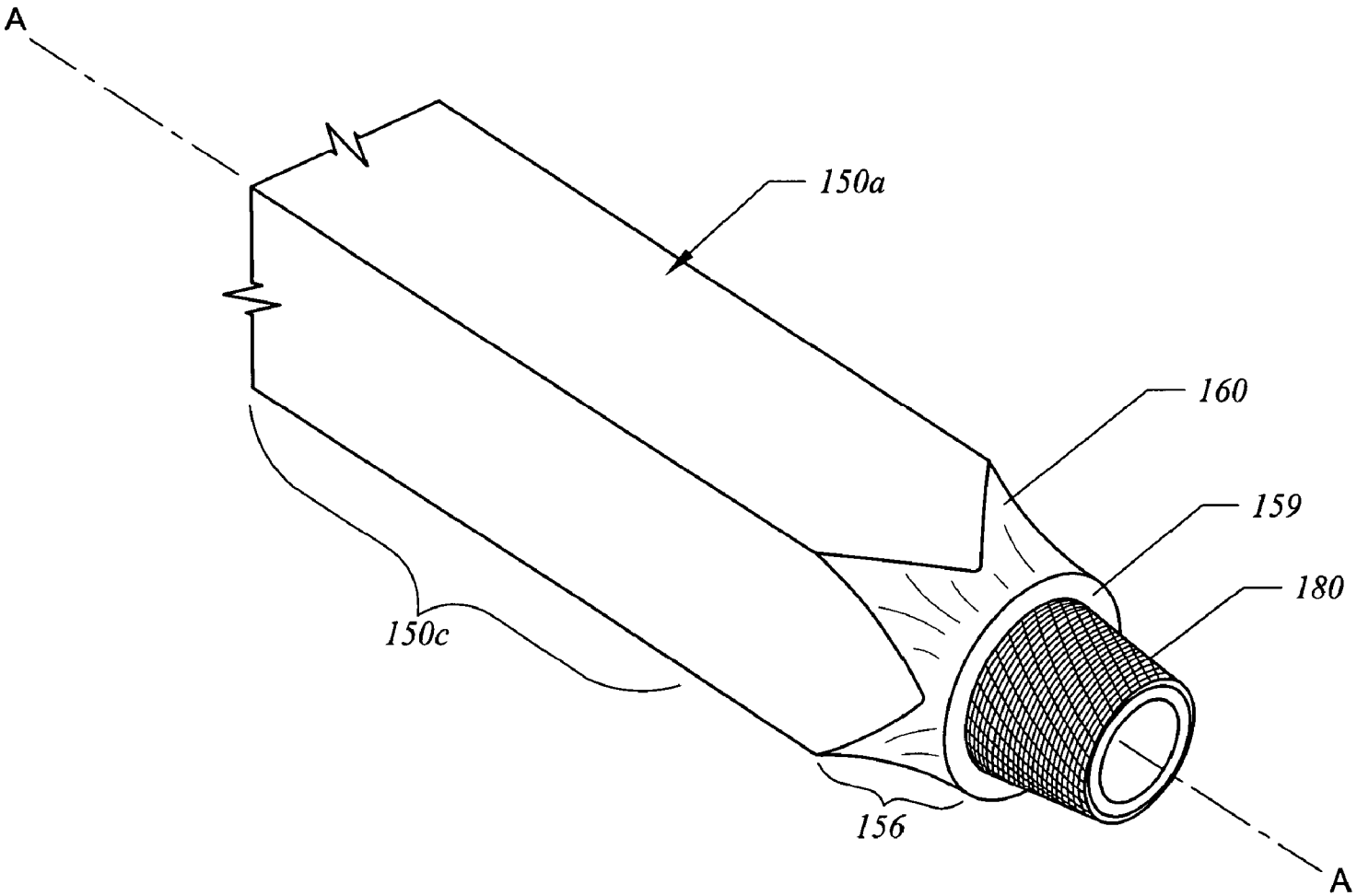
FIG. 11 illustrates the tip of a Kelly bar section, showing the threaded member used to connect it to an adjacent Kelly bar section.

FIG. 11 is a schematic representation illustrating Kelly section 150*a* with tapered, toroidal surface 160 formed therein and which illustrates tapered thread 180 which allows section 150*a* to be threaded into adjoining Kelly section 150*b* (not shown for clarity). Tapered threaded member 180 threads into a correspondingly tapered recess formed in the upper end of Kelly section 150*b*.

The Kelly bar sections preferably have square cross-sections. However, other polygonal cross-sections such as triangular, pentagonal and hexagonal could be utilized.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated.

What is claimed is:

1. A drive mechanism for a subterranean soil processing tool wherein a crane has a boom, a lead column and a rotary drive table, and Kelly bar sections are joined together on a vertical axis (A-A) and rotated around said (A-A) axis by said rotary drive table to advance said soil processing tool downwardly, each of said Kelly bar sections having a central region, an upper end and a lower end, and an upper tip and a lower tip, characterized by:

each of said Kelly bar sections having a polygonal cross-section with flat faces in said central region, said rotary drive table is positioned at the bottom of said lead column, a roller drive assembly connected to said rotary drive table, said roller drive assembly having a plurality of rollers, each roller mounted to rotate about a horizontal axis parallel to one of said polygonal faces, each roller contacting a flat face of said central region of said Kelly bar, whereby as said rotary drive table rotates around said vertical (A-A) axis, said roller drive assembly rotates said Kelly bar around said vertical (A-A) axis, wherein each Kelly bar section is tapered at its upper and lower ends in a manner whereby the cross-section of said upper and lower ends is reduced toward said upper tip and said lower tip, and wherein when either said upper tip or lower tip of a Kelly bar section is adjacent said roller drive assembly, said rollers do not contact a flat polygonal face or said tapered upper or lower end of said Kelly bar section, whereby said rotary drive assembly is free to rotate relative to said Kelly bar section without causing rotation of said Kelly bar section around said (A-A) axis, whereby misaligned adjacent Kelly bar sections may pass through said roller drive assembly.

2. The apparatus of claim 1 wherein each said polygon cross section is a square cross section.

3. A drive mechanism for a subterranean soil processing tool wherein a crane has a boom, a lead column and a rotary drive table, and multiple Kelly bar sections are joined together on a vertical axis (A-A) and rotated around said vertical (A-A) axis by said rotary drive table to advance said soil processing tool downwardly, each of said Kelly bar sections having a central section, an upper end and a lower end, an upper tip and a lower tip, characterized by:

each of said Kelly bar central sections having a square cross-section with four flat faces, a roller drive assembly connected to said rotary drive table, said roller drive assembly having four rollers, each roller mounted to rotate about a horizontal axis parallel to one of said faces, whereby as said rotary drive table rotates around said vertical (A-A) axis, the rollers of said roller drive assembly each contact a face of said central region of said Kelly bar and rotates said Kelly bar around said vertical (A-A) axis, wherein adjacent Kelly bar sections form a joint where the sections are connected to each other, and wherein the upper and lower ends of each Kelly bar sections are tapered inwardly toward said (A-A) axis to form reduced cross-sectional areas toward said joint between adjacent sections and wherein said roller drive assembly is free to rotate around said (A-A) axis at each of said Kelly bar joints without rotating said Kelly bar, whereby a misaligned Kelly bar joint may pass through said rotary drive table either upwardly or downwardly.

4. The apparatus of claim 3 wherein each of said joints is formed by utilizing an imaginary torus extending around said joint.

5. The apparatus of claim 4 wherein the diameter of said torus is greater than the width of each of said faces of said Kelly bar.

* * * * *